US010179451B2

(12) United States Patent
Matsuda

(10) Patent No.: US 10,179,451 B2
(45) Date of Patent: Jan. 15, 2019

(54) LIQUID EJECTION HEAD AND INK JET PRINTER

(71) Applicant: KONICA MINOLTA, INC., Chiyoda-ku, Tokyo (JP)

(72) Inventor: Shinya Matsuda, Takarazuka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/547,247

(22) PCT Filed: Jan. 28, 2016

(86) PCT No.: PCT/JP2016/052417
§ 371 (c)(1),
(2) Date: Jul. 28, 2017

(87) PCT Pub. No.: WO2016/121849
PCT Pub. Date: Aug. 4, 2016

(65) Prior Publication Data

US 2018/0022096 A1 Jan. 25, 2018

(30) Foreign Application Priority Data

Jan. 30, 2015 (JP) ..... 2015-016529

(51) Int. Cl.
*B41J 2/14* (2006.01)
*B41J 2/16* (2006.01)
(Continued)

(52) U.S. Cl.
CPC ..... *B41J 2/14233* (2013.01); *B41J 2/04525* (2013.01); *B41J 2/055* (2013.01);
(Continued)

(58) Field of Classification Search
CPC .. B41J 2/14233; B41J 2/1433; B41J 2/04525; B41J 2202/07
See application file for complete search history.

(56) References Cited

U.S. PATENT DOCUMENTS

2005/0195248 A1* 9/2005 Nagashima ..... B41J 2/0451 347/68

FOREIGN PATENT DOCUMENTS

EP 2106911 A1 10/2009
JP S55071569 A 5/1980
(Continued)

OTHER PUBLICATIONS

Extended European Search Report corresponding to Application No. 16743452.1-1019/3251855 PCT/JP2016052417; dated Jan. 12, 2018.

(Continued)

*Primary Examiner* — Geoffrey S Mruk
(74) *Attorney, Agent, or Firm* — Cantor Colburn LLP

(57) ABSTRACT

A liquid ejection head includes an ejection port to eject liquid, a pressure chamber communicating with the ejection port, and a piezoelectric element to pressurize the pressure chamber and eject from the ejection port, the liquid stored in the pressure chamber. At least a part of a wall portion defining the pressure chamber includes a portion where vibration characteristics are different between a pressurized state in which the pressure chamber is pressurized by the piezoelectric element and a depressurized state in which the pressure chamber is depressurized by ejecting the liquid from the ejection port and stopping pressurization to the pressure chamber, and the portion having different vibration characteristics is adapted to reduce pressure fluctuation in the pressure chamber in the depressurized state.

16 Claims, 10 Drawing Sheets

(51) Int. Cl.
*B41J 2/045* (2006.01)
*B41J 2/055* (2006.01)

(52) U.S. Cl.
CPC ..... *B41J 2/14* (2013.01); *B41J 2/1433* (2013.01); *B41J 2/16* (2013.01); *B41J 2202/07* (2013.01)

(56) References Cited

FOREIGN PATENT DOCUMENTS

| | | | |
|---|---|---|---|
| JP | S57032976 | A | 2/1982 |
| JP | H07304171 | A | 11/1995 |
| JP | 2006095725 | A | 4/2006 |
| JP | 2006198903 | A | 8/2006 |
| JP | 2007313761 | A | 12/2007 |
| JP | 2010162862 | A | 7/2010 |

OTHER PUBLICATIONS

International Search Report corresponding to Application No. PCT/JP2016/052417; dated Apr. 26, 2016.

* cited by examiner

LIQUID EJECTION HEAD AND INK JET PRINTER

CROSS REFERENCE TO RELATED APPLICATIONS

This is the U.S. national stage of application No. PCT/JP2016/052417, filed on Jan. 28, 2016. Priority under 35 U.S.C. § 119(a) and 35 U.S.C. § 365(b) is claimed from Japanese Application No. 2015-016529, filed Jan. 30, 2015, the disclosure of which is also incorporated herein by reference.

TECHNICAL FIELD

The present invention relates to a liquid ejection head to eject liquid such as ink droplets, and an ink jet printer.

BACKGROUND ART

There is a known ink jet printer including a plurality of channels adapted to eject ink and adapted to output a two-dimensional image by controlling ink ejection while moving relative to a recording medium such as paper or cloth. For an ink ejection method, there are known methods of, for example, a pressure type by various actuators such as a piezoelectric actuator, an electrostatic actuator, or an actuator utilizing thermal deformation, a thermal type that generates bubbles by heat, and the like.

A liquid ejection head included in the above-described ink jet printer has a structure in which ink supplied from an ink supply source is distributed to each pressure chamber from a common chamber and then reaches an ejection port. When the pressure chamber is pressurized by an actuator or the like, the ink is ejected from the ejection port. Pressure waves generated at the time of pressurizing the pressure chamber pass through the common chamber and propagate to another pressure chamber communicating with the common chamber, and pressure fluctuation is induced in the pressure chamber. In the case where such pressure fluctuation is induced, ink ejection characteristics in the pressure chamber may be changed and ejection failure may occur.

To prevent such ejection failure, it may be possible to exemplify patent literature such as JP 2006-95725 A (Patent Literature 1), JP 2006-198903 A (Patent Literature 2), and JP 2007-313761 A (Patent Literature 3) disclosing a liquid ejection head including a damper portion that attenuates pressure waves propagating to a common chamber.

According to the liquid ejection head disclosed in Patent Literature 1, a recess portion is provided in a reinforcing plate located outside a wall portion such that a part of the wall portion defining a common chamber can be warped and deformed outward. According to the liquid ejection head disclosed in Patent Literature 2, a part of a wall portion defining a common chamber is formed of a flexible ink plate.

According to the liquid ejection head disclosed in Patent Literature 3, a part of a wall portion defining a common chamber is formed in a deformable manner and a viscoelastic material is provided in a manner contacting this deformable portion.

However, even in the case where pressure waves propagating to the common chamber are attenuated as disclosed in Patent Literatures 1 to 3, bubbles may be generated due to cavitation because a pressure inside a pressure chamber becomes negative after ink is ejected from an ejection port. Specifically, in the case where the pressure inside the pressure chamber becomes lower than a saturated vapor pressure of the ink, nuclei of fine bubbles are generated and the nuclei grow into bubbles. When such bubbles exist in the pressure chamber, the ink may not be able to be ejected from the ejection port due to nozzle clogging or pressure loss. Consequently, image failure may be caused.

On the other hand, according to JP 7-304171 A (Patent Literature 4), a thin layer made of a material having an elastic coefficient lower than that of a piezoelectric material constituting an actuator plate is formed on a part of a wall of an ink liquid chamber corresponding to the above-described pressure chamber so as to attenuate a peak of a negative pressure after ink ejection.

CITATION LIST

Patent Literature

Patent Literature 1: JP 2006-95725 A
Patent Literature 2: JP 2006-198903 A
Patent Literature 3: JP 2007-313761 A
Patent Literature 4: JP 7-304171 A

SUMMARY OF INVENTION

Technical Problem

However, according to a configuration of Patent Literature 4, since influence of a thin layer is received during both pressurization and depressurization, a driving pressure may be decreased and high output of an actuator may not be achieved.

Here, frequency of bubble generation is determined by a physical property of ink, a volume of a pressure chamber, a negative pressure level, a fluctuation rate of the negative pressure, and the like. Recently, higher speed performance and higher resolution are in progress in an ink jet printer for business use. High output of the actuator is needed for such achievement.

When high speed performance is achieved in an ink jet printer, a drive frequency of a liquid ejection head becomes high and pressure fluctuation is increased. Additionally, it is desirable that ink has high viscosity in order to quickly dry the ejected ink on a recording medium, and a pressure needed to eject the ink is also increased by this.

Furthermore, when resolution of the ink jet printer is made higher, an amount of ink droplets to be ejected is decreased, and the pressure needed to eject the ink is further increased. Also, when the resolution is made higher, many channels are needed in one ink jet printer, and miniaturization of the channel is desired. When capacity of the pressure chamber is decreased due to miniaturization, a coefficient of volume fluctuation inside the pressure chamber is increased.

In the ink jet printer demanded to achieve thus higher speed performance and higher resolution, achieving high output and suppressing bubble generation inside the pressure chamber caused by cavitation are problems to be solved in order to achieve higher speed performance and higher resolution despite an environment in which frequency of bubble generation tends to be increased.

The present invention is made in consideration of the above-described problems, and the present invention is directed to providing a liquid ejection head and an ink jet printer adapted to suppress bubble generation inside the pressure chamber while maintaining high output.

Solution to Problem

A liquid ejection head according to the present invention includes: an ejection port adapted to eject liquid; a pressure chamber communicating with the ejection port; and a piezoelectric element adapted to pressurize the pressure chamber and eject, from the ejection port, the liquid stored in the pressure chamber, wherein at least a part of a wall portion defining the pressure chamber includes a portion where vibration characteristics are different between a pressurized state in which the pressure chamber is pressurized by the piezoelectric element and a depressurized state in which the pressure chamber is depressurized by ejecting the liquid from the ejection port and stopping pressurization to the pressure chamber, and the portion having different vibration characteristics is adapted to reduce pressure fluctuation in the pressure chamber in the depressurized state.

The ink jet printer according to the present invention includes the above-described liquid ejection head and performs printing by ejecting liquid toward a recording medium from the liquid ejection head.

Advantageous Effects of Invention

According to the present invention, it is possible to provide the liquid ejection head and the ink jet printer adapted to suppress bubble generation inside the pressure chamber while maintaining high output.

DESCRIPTION OF EMBODIMENTS

Figure 1:
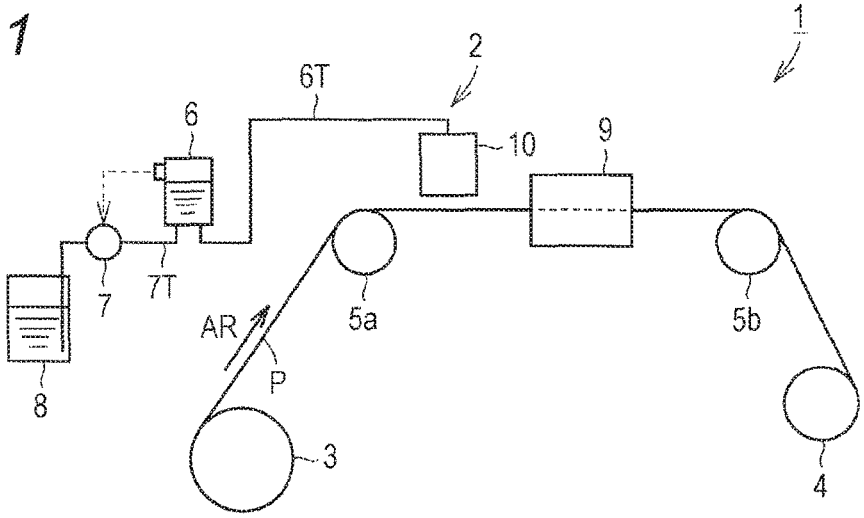
FIG. 1 is a diagram schematically illustrating an ink jet printer according to a first embodiment.

In the following, embodiments of the present invention will be described in detail with reference to the drawings. In the following embodiments, note that same or common portions are denoted by the same reference signs in the drawings and description therefor will not be repeated.

First Embodiment (Ink Jet Printer)

FIG. 1 is a diagram schematically illustrating an ink jet printer according to the present embodiment. An ink jet printer 1 according to the present embodiment will be described with reference to FIG. 1.

As illustrated in FIG. 1, the ink jet printer 1 according to the present embodiment includes an ink jet head portion 2, a feed roll 3, a wind-up roll 4, back rolls 5*a* and 5*b*, an intermediate tank 6, a liquid feed pump 7, a storage tank 8, a fixing device 9, a liquid ejection head 10, and pipe lines 6T and 7T.

The feed roll 3 feeds a recording medium P in a direction indicated by an arrow AR. The recording medium P is, for example, a printing paper or cloth. The wind-up roll 4 winds up the recording medium P fed from the feed roll 3 and having an image formed thereon at the ink jet head portion 2. The back rolls 5*a* and 5*b* are provided between the feed roll 3 and the wind-up roll 4.

Ink stored in the storage tank 8 is supplied to the intermediate tank 6 through the liquid feed pump 7 and the pipeline 7T. The ink stored in the intermediate tank 6 is supplied from the intermediate tank 6 to the liquid ejection head 10 through the piping line 6T. The liquid ejection head 10 ejects ink onto the recording medium P in the ink jet head portion 2. The fixing device 9 fixes the ink supplied onto the recording medium P to the recording medium P. In the ink jet printer 1, an image can be formed on the recording medium P as described above.

(Liquid Ejection Head)

Figure 2:
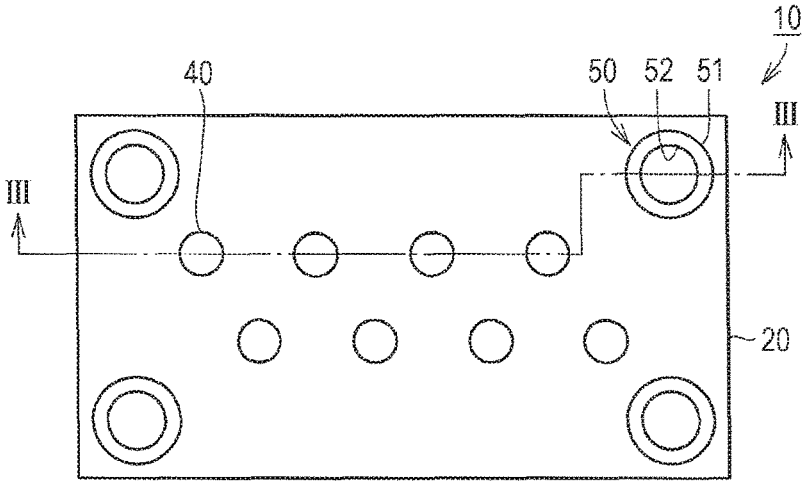
FIG. 2 is a top view of the liquid ejection head illustrated in FIG. 1.
Figure 3:
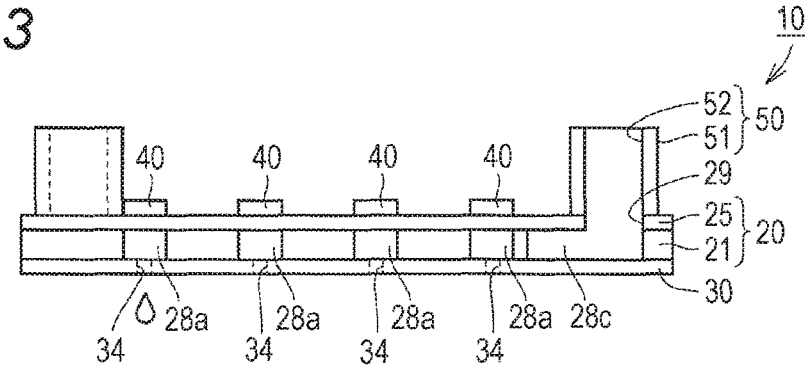
FIG. 3 is a cross-sectional view taken along a line illustrated in FIG. 2.
Figure 4:
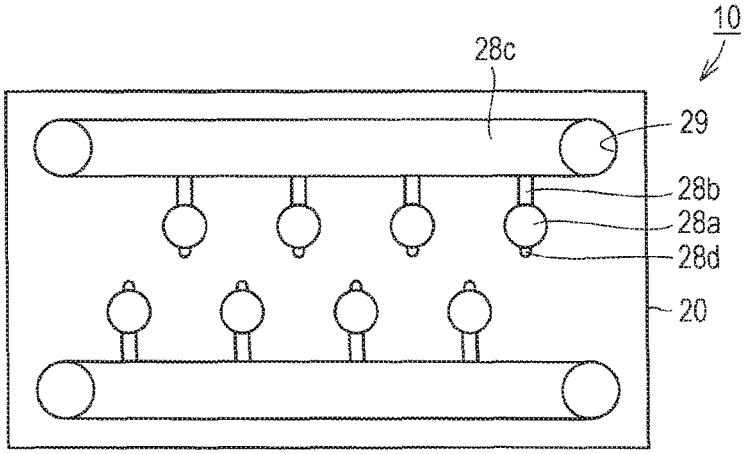
FIG. 4 is a view illustrating a liquid flow passage formed in the liquid ejection head illustrated in FIG. 1.
Figure 5:
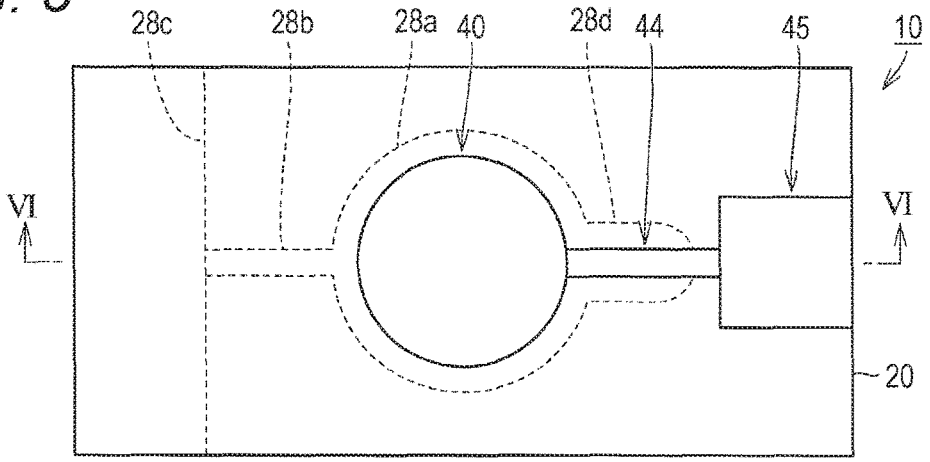
FIG. 5 is a diagram schematically illustrating one channel formed in the liquid ejection head illustrated in FIG. 1.

FIG. 2 is a top view of the liquid ejection head illustrated in FIG. 1. FIG. 3 is a cross-sectional view taken along a line illustrated in FIG. 2. FIG. 4 is a diagram illustrating a liquid flow passage formed in the liquid ejection head illustrated in FIG. 1. FIG. 5 is a diagram schematically illustrating one channel formed in the liquid ejection head illustrated in FIG. 1. The liquid ejection head 10 according to the present embodiment will be described with reference to FIGS. 2 to 5.

As illustrated in FIGS. 2 to 4, the liquid ejection head 10 includes a basal plate 20, a nozzle plate 30, a plurality of piezoelectric elements 40, and an ink supply unit 50. The basal plate 20 is a member that functions as a base in order to form a liquid flow passage inside thereof, stack the piezoelectric elements 40, join the nozzle plate 30, and join the ink supply unit 50. The liquid ejection head 10 has a plurality of channels arranged in two rows.

The basal plate 20 has a substantially rectangular shape in the plan view. The basal plate 20 includes portions to become a pressure chamber 28*a*, a communication passage 28*b*, a common chamber 28*c*, and an auxiliary chamber 28*d* by being joined to the nozzle plate 30, and also includes an ink supply hole 29 to supply ink to the common chamber 28*c*.

A plurality of pressure chambers 28*a* is formed. The plurality of pressure chambers 28*a* is arrayed zigzag. Specifically, the plurality of pressure chambers 28*a* aligned like a row in a longitudinal direction of the basal plate 20 is arranged in parallel in two rows in a short-side direction of the basal plate 20, and the plurality of pressure chambers 28*a* constituting a first row and the plurality of pressure chambers 28*a* constituting a second row are arranged in an alternating manner.

Two common chambers 28*c* are formed. The two common chambers 28*c* are provided in a manner interposing the plurality of pressure chambers 28*a* in the short-side direction of the basal plate 20. The two common chambers 28*c* are provided in a manner extending in the longitudinal direction of the basal plate 20.

One common chamber 28*c* out of the two common chambers 28*c* communicates, via the communication passage 28*b*, with each of the plurality of pressure chambers 28*a* constituting the first row. The other common chamber 28*c* of the two common chambers 28*c* communicates, via the communication passage 28*b*, with each of the plurality of pressure chambers 28*a* constituting the second row.

The auxiliary chamber 28*d* is provided at a tip of the pressure chamber 28*a*. The auxiliary chamber 28*d* is provided on a side opposite to a side where the communication passage 28*b* is located. The auxiliary chamber 28*d* connects the pressure chamber 28*a* to the nozzle hole 34 as described later.

The basal plate 20 includes a body portion 21 and a vibration layer 25. Structures of the body portion 21 and the vibration layer 25 will be described later using FIGS. 5 and 6.

The nozzle plate 30 includes a plurality of nozzle holes 34. The plurality of nozzle holes 34 is arrayed zigzag in a manner corresponding to the plurality of pressure chambers 28*a*. Each of the plurality of nozzle holes 34 communicates with each of the pressure chambers 28*a* via the auxiliary chamber 28*d*. The plurality of nozzle holes 34 functions as ejection ports to eject ink droplets.

The plurality of piezoelectric elements 40 is provided in a manner corresponding to the plurality of pressure chambers 28*a* in a one-to-one relation. The piezoelectric element 40 is provided in a manner interposing the vibration layer 25 between the piezoelectric element 40 and the pressure chamber 28*a*. The piezoelectric element 40 pressurizes the pressure chamber 28*a* and ejects ink stored in the pressure chamber 28*a* from the nozzle hole 34. A structure of the piezoelectric element 40 will be described later using FIGS. 5 and 6.

The ink supply unit 50 has a cylindrical portion 51 and an ink introduction passage 52. The cylindrical portion 51 has, for example, a substantially cylindrical shape. The ink introduction passage 52 is defined by an inner peripheral surface of the cylindrical portion 51. The ink introduction passage 52 communicates with the ink supply hole 29 provided in the vibration layer 25 of the basal plate 20.

Figure 6:
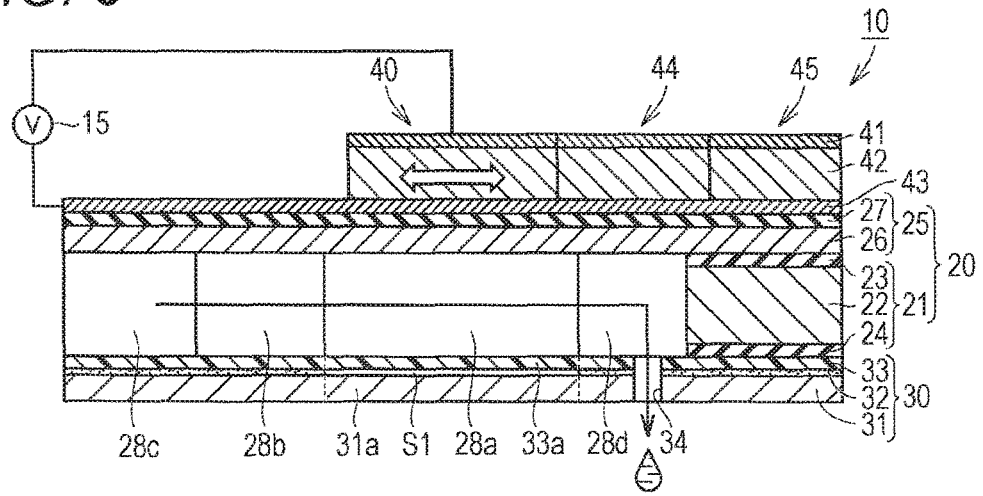
FIG. 6 is a cross-sectional view taken along a line VI-VI illustrated in FIG. 5.

FIG. 5 is a diagram schematically illustrating one channel formed in the liquid ejection head illustrated in FIG. 1. FIG. 6 is a cross-sectional view taken along a line VI-VI illustrated in FIG. 5. The channel included in the liquid ejection head is a portion to eject ink and also is a portion corresponding to one pressure chamber 28*a*.

As illustrated in FIGS. 5 and 6, the channel includes: the basal plate 20 including the body portion 21 and the vibration layer 25; the piezoelectric element 40 arranged on the basal plate 20; a connecting portion 44; a wiring portion 45; the nozzle plate 30; the pressure chamber 28*a*; the communication passage 28*b*; the common chamber 28*c*; and the auxiliary chamber 28*d*.

The body portion 21 has a body base plate 22 and insulation films 23 and 24. The body base plate 22 is made of, for example, silicon. The insulation films 23 and 24 are made of, for example, silicon oxide ($SiO_2$). The insulation films 23 and 24 are provided on both main surfaces of the body base plate 22.

The vibration layer 25 is provided in a manner stretching over the pressure chamber 28*a*, communication passage 28*b*, common chamber 28*c*, and auxiliary chamber 28*d*. Thus, the vibration layer 25 constitutes an upper wall for the pressure chamber 28*a*, communication passage 28*b*, common chamber 28*c*, and auxiliary chamber 28*d*. The vibration layer 25 is partly vibrated by expansion and contraction of the plurality of piezoelectric elements 40 provided in a manner corresponding to the plurality of pressure chambers 28*a*.

The vibration layer 25 has a driven plate 26 and an insulation film 27. The driven plate 26 is made of, for example, silicon. The insulation film 27 is formed of silicon oxide. The insulation film 27 is provided on a main surface of the driven plate 26 located on a side opposite to a side where the body portion 21 is located.

The piezoelectric element 40, connecting portion 44, and wiring portion 45 are provided on the main surface of the vibration layer 25 located on the side opposite to the side wherein the body portion 21 is located. The piezoelectric element 40 is provided above the pressure chamber 28*a*. The connecting portion 44 is provided above the auxiliary chamber 28*d*. The wiring portion 45 is provided above the body base plate 22.

The piezoelectric element 40, connecting portion 44, and wiring portion 45 are formed by stacking a lower electrode 43, a piezoelectric body 42, and an upper electrode 41 in this order.

The lower electrode 43 is provided on the main surface of the vibration layer 25 located on the side opposite to the side where the body portion 21 is located. The lower electrode 43 is formed of a metal layer including titanium, a platinum layer, and the like.

The piezoelectric body 42 is provided on the main surface of the lower electrode 43 located on a side opposite to a side where the insulation film 27 is located. The piezoelectric body 42 is made of a perovskite-type metal oxide such as barium titanate ($BaTiO_3$) or lead zirconate titanate ($Pb(Ti/Zr)O_3$).

The upper electrode 41 is provided on a main surface of the piezoelectric body 42 located on a side opposite to a side where the lower electrode 43 is located. The upper electrode 41 is formed of a metal layer including titanium, a platinum layer, and the like.

The upper electrode 41 and the lower electrode 43 are provided in a manner interposing the piezoelectric body 42 therebetween. The upper electrode 41 and the lower electrode 43 are connected to the driving unit 15. The piezoelectric body 42 is driven based on voltage (drive signal) applied from the driving unit 15 to the upper electrode 41 and the lower electrode 43.

The piezoelectric body 42 expands and contracts based on the drive signal, thereby partly vibrating the vibration layer 25. Consequently, the piezoelectric element 40 pressurizes the pressure chamber 28*a* corresponding to the piezoelectric element 40, and ejects the ink stored in the pressure chamber 28*a* from the nozzle hole 34.

The nozzle plate 30 is joined to a main surface of the basal plate 20 located on a side opposite to a side where the piezoelectric element 40 is located. The nozzle plate 30 is provided in a manner stretching over the pressure chamber 28*a*, communication passage 28*b*, common chamber 28*c*, and auxiliary chamber 28*d*. Thus, the nozzle plate 30 constitutes a lower wall for the pressure chamber 28*a*, communication passage 28*b*, common chamber 28*c*, and auxiliary chamber 28*d*.

The nozzle plate 30 includes a base plate 31, an adhesive layer 32, a resin plate 33, an air layer S1, and the nozzle hole 34.

The base plate 31 is made of, for example, silicon. The adhesive layer 32 is provided on a main surface of the base plate 31 facing the basal plate 20 except for a portion 31*a* included in the base plate 31 and locationally corresponding to the pressure chamber 28*a*. The adhesive layer 32 has a thickness of about several μm to 20 μm.

The resin plate 33 is formed of, for example, an epoxy resin film. The resin plate 33 has a thickness of about 50 μm to 100 μm. The resin plate 33 is formed to have rigidity lower than rigidity of the base plate 31.

The resin plate 33 is joined to the base plate 31 by the adhesive layer 32 except for a portion 33*a* locationally corresponding to the pressure chamber 28*a*. Consequently, the air layer S1 (gap) is formed between the portion 33*a* included in the resin plate 33 and locationally corresponding to the pressure chamber 28*a* and the portion 31*a* included in the base plate 31 and locationally corresponding to the pressure chamber 28*a*.

A lower wall of the pressure chamber 28*a* is constituted by the portion 33*a* included in the resin plate 33 and locationally corresponding to the pressure chamber 28*a*, the portion 31*a* of the base plate 31 locationally corresponding to the pressure chamber 28*a*, and the air layer S1 located therebetween.

Thus, since the lower wall of the pressure chamber 28*a* is formed by sequentially arranging the resin plate 33 (first layer) having low rigidity and the base plate 31 (second layer) having high rigidity from the pressure chamber 28*a* side so as to form the gap therebetween, the lower wall of the pressure chamber 28*a* has vibration characteristics different between a pressurized state in which the pressure chamber 28*a* is pressurized by the piezoelectric element 40 and a depressurized state in which the pressure chamber 28*a* is depressurized by ejecting ink from the nozzle hole 34 and stopping pressurization to the pressure chamber 28*a*.

(Deformation Behavior of Pressure Chamber)

Figure 7:
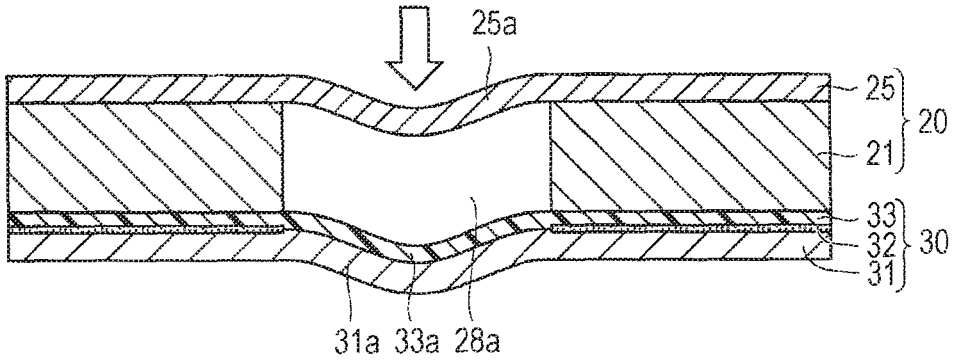
FIG. 7 is a view illustrating a pressurized state in which a pressure chamber of the liquid ejection head illustrated in FIG. 1 is pressurized.
Figure 8:
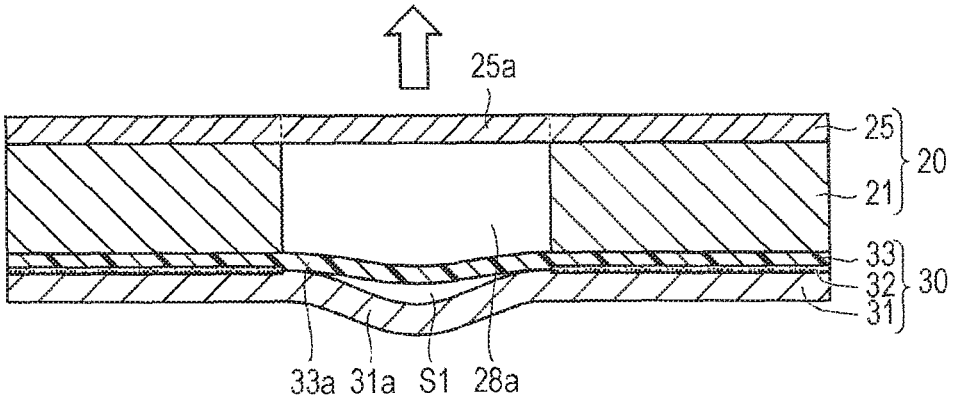
FIG. 8 is a view illustrating a depressurized state in which the pressure chamber of the liquid ejection head illustrated in FIG. 1 is depressurized.

FIG. 7 is a view illustrating the pressurized state in which the pressure chamber of the liquid ejection head illustrated in FIG. 1 is pressurized. FIG. 8 is a diagram illustrating the depressurized state which the pressure chamber of the liquid ejection head illustrated in FIG. 1 is depressurized. Deformation behavior of the pressure chamber will be described with reference to FIGS. 7 and 8.

As illustrated in FIG. 7, when a drive signal is applied to the piezoelectric body 42, a portion 25*a* included in the vibration layer and constituting the upper wall of the pressure chamber 28*a* is curved so as to come close to the nozzle plate 30, and deformed so as to have a shape recessed downward. Thus, the pressurized state in which the pressure chamber 28*a* is pressurized is obtained.

When the pressure chamber 28*a* is pressurized, a portion included in the nozzle plate 30 and constituting the lower wall of the pressure chamber 28*a* is curved so as to move away from the vibration layer 25, and deformed so as to have a shape recessed downward. At this point, a portion 33*a* included in the resin plate 33 and locationally corresponding to the pressure chamber 28*a* is deformed together with the portion 31*a* in a state that the portion 33*a* contacts the portion 31*a* included in the base plate 31 locationally corresponding to the pressure chamber 28*a*.

Consequently, rigidity of the lower wall of the pressure chamber 28*a* in the pressurized state is obtained by adding the rigidity of the resin plate 33 and the rigidity of the base plate 31. Furthermore, since the resin plate 33 and the base plate 31 are deformed in a state of contacting each other, decrease of driving force can also be prevented. Consequently, high output can be maintained.

As illustrated in FIG. 8, when a drive signal of the piezoelectric body 42 is removed, the portion 25*a* included in the vibration layer and constituting the upper wall of the pressure chamber 28*a* returns to an original state, and the depressurized state in which the pressure chamber 28*a* is depressurized is obtained.

When the pressure chamber 28*a* is depressurized, deformation of the portion included in the nozzle plate 30 and constituting the lower wall of the pressure chamber 28*a* also attempts to return to an original state. At this point, since the rigidity of the resin plate 33 is lower than the rigidity of the base plate 31, the resin plate 33 is deformed in a manner returning to the original state earlier than the base plate 31.

Consequently, the rigidity of the lower wall of the pressure chamber 28*a* in the depressurized state becomes close to rigidity of the portion 33*a* included in the resin plate 33 and locationally corresponding to the pressure chamber 28*a*. The rigidity of the lower wall of the pressure chamber 28*a* in the depressurized state becomes lower than the rigidity of the lower wall of the pressure chamber 28*a* in the pressurized state.

Since the portion 33*a* included in the resin plate 33 and locationally corresponding to the pressure chamber 28*a* has the low rigidity, the portion 33*a* is independently deformed separately from the base plate 31 in the depressurized state and deformed so as to come close to the vibration layer 25 in accordance with pressure change in the pressure chamber 28*a*. In other words, the portion 33*a* included in the resin plate 33 and locationally corresponding to the pressure chamber 28*a* is deformed so as to reduce pressure fluctuation in the pressure chamber 28*a* in the depressurized state. Consequently, a negative pressure generated inside the pressure chamber 28*a* is reduced, and bubble generation is suppressed.

Here, the portion 33*a* included in the resin plate 33 and locationally corresponding to the pressure chamber 28*a* has a periphery bonded and fixed by the adhesive layer 32.

Rigidity of a thin film having a periphery constrained like the lower wall of the pressure chamber 28*a* in the present embodiment is generally measured by the "bulge test method". According to this method, a positive pressure and a negative pressure are applied to the thin film having the periphery constrained, and rigidity is calculated based on a deformed amount of the thin film.

In the present embodiment, the rigidity of the thin film, namely, the above-described lower wall at the time of applying a positive pressure is equal to a value obtained by adding the rigidity of the portion 31*a* included in the base plate 31 and locationally corresponding to the pressure chamber 28*a* and the rigidity of the portion 33*a* included in the resin plate 33 and locationally corresponding to the pressure chamber 28*a*. Therefore, the rigidity of the lower wall at the time of applying the positive pressure becomes higher than the rigidity of the lower wall at the time of applying a negative pressure (rigidity of the portion 33*a* included in the resin plate 33 and locationally corresponding to the pressure chamber 28*a*). Such a rigidity difference between the pressurized state and the depressurized state causes different vibration characteristics.

Also, as described above, the lower wall of the pressure chamber 28*a* is deformed so as to move away from the vibration layer 25 in the pressurized state while the lower wall is deformed so as to come close to the vibration layer 25 attempting to return to the original state in the depressurized state. Therefore, it can be said that the rigidity of the lower wall has different anisotropy depending on a deforming direction.

(Ink Ejecting Operation and State of Pressure Chamber)

Figure 9A:
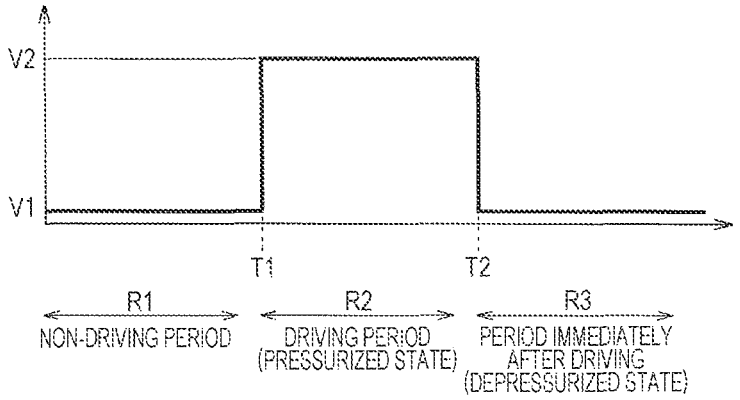
FIGS. 9A and 9B includes 9A which is a diagram illustrating temporal change of driving voltage applied to a piezoelectric element when the liquid ejection head illustrated in FIG. 1 ejects liquid, and 9B which is a diagram illustrating temporal pressure change inside the pressure chamber when the liquid ejection head illustrated in FIG. 1 ejects the liquid and also a state inside the pressure chamber in each of pressure states.
Figure 9B:
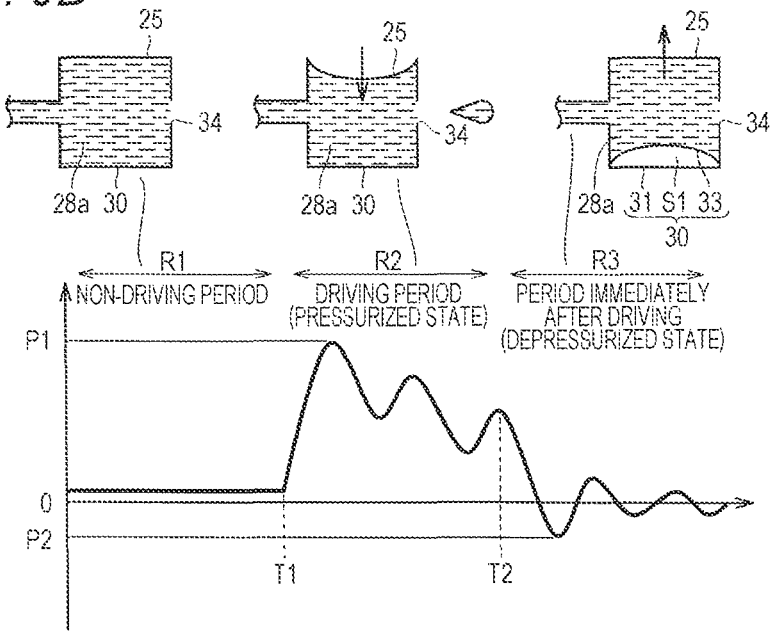

FIG. 9A is a diagram illustrating temporal change of driving voltage applied to the piezoelectric element when the liquid ejection head illustrated in FIG. 1 ejects liquid. FIG. 9B is a diagram illustrating temporal change of a pressure inside the pressure chamber when the liquid ejection head illustrated in FIG. 1 ejects the liquid and also a state inside the pressure chamber in each of the pressure states. Ink ejecting operation and the state of the pressure chamber associated with the operation will be described with reference to FIGS. 9 and 9B.

As illustrated in FIG. 9A, driving voltage having a pulse-like waveform is applied to the piezoelectric element 40 at the time of ejecting ink. Incidentally, a level of the applied driving voltage (value of V2−V1), an application period, and a frequency can be suitably set in accordance with specifications of the ink jet printer and performance of the ink jet head.

Reference voltage V1 is applied to the piezoelectric element 40 until time T1. At the time T1, the applied voltage is increased, voltage V2 is applied to the piezoelectric element 40, and this state is kept until time T2. At the time T2, the voltage applied to the piezoelectric element 40 is changed to the reference voltage V1, and this state is kept until next ejection timing.

Here, a period to the time T1 is defined as a non-driving period R1, a period from the time T1 to the time T2 as a driving period R2, and a period from the time T2 to a predetermined time as a period immediately after driving R3.

As illustrated in FIG. 9B, since the piezoelectric element 40 is not driven during the non-driving period R1, the pressure inside the pressure chamber 28*a* is kept constant. Next, during the driving period R2, the piezoelectric element 40 is deformed, thereby curving a part of the vibration layer 25 in a direction coming close to the nozzle plate 30. Consequently, the pressure chamber 28*a* is pressurized up to a pressure value P1 by the piezoelectric element 40 and brought into the pressurized state. As a result, the ink is ejected from the nozzle hole 34.

During the period immediately after driving R3, the applied voltage is put back to the reference voltage, thereby returning the piezoelectric element 40 from the deformed state, and the vibration layer 25 also attempts to return to the original state. During the period immediately after driving R3, the inside of the pressure chamber 28*a* is depressurized and brought into the depressurized state by ejecting the ink from the nozzle hole 34 during the driving period R2 and stopping pressurization to the pressure chamber 28*a*.

During the period immediately after driving R3, a portion included in the resin plate 33 and not bonded to the base plate 31 is deformed so as to reduce pressure fluctuation inside the pressure chamber 28*a* as described above. Consequently, the pressure inside the pressure chamber 28*a* stays within a pressure P2, and it is possible to prevent the negative pressure from being increased. As a result, bubble generation is suppressed.

Comparative Example

Figure 10:
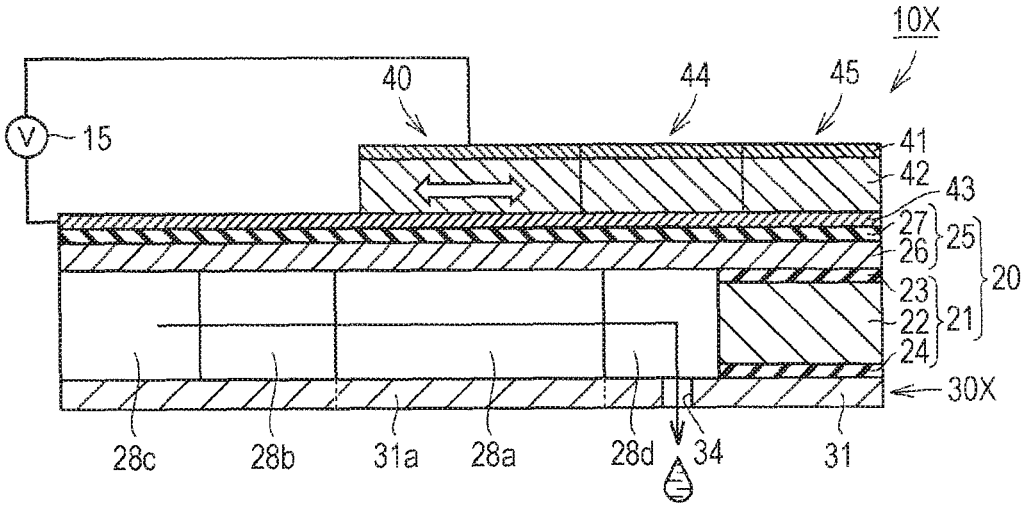
FIG. 10 is a cross-sectional view of a liquid ejection head in a comparative example.
Figure 11A:
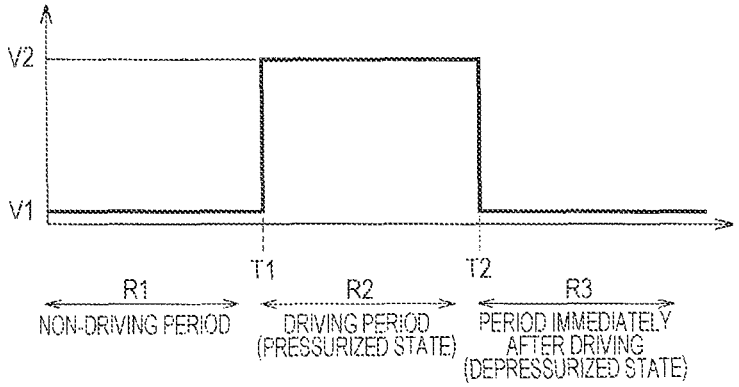
FIGS. 11A and 11B includes 11A which is a diagram illustrating temporal change of driving voltage applied to a piezoelectric element when the liquid ejection head illustrated in FIG. 10 ejects liquid, and 11B which is a diagram illustrating temporal pressure change inside a pressure chamber when the liquid ejection head illustrated in FIG. 10 ejects the liquid and also a state inside the pressure chamber in each of pressure states.
Figure 11B:
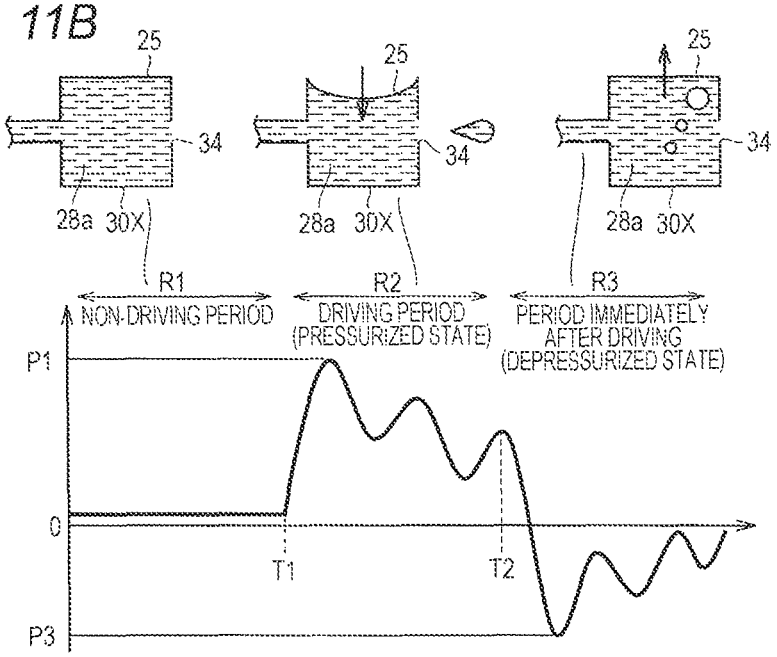

FIG. 10 is a cross-sectional view of a liquid ejection head in a comparative example. FIG. 11A is a diagram illustrating temporal change of driving voltage applied to a piezoelectric element when the liquid ejection head illustrated in FIG. 10 ejects liquid. FIG. 11B is a diagram illustrating temporal pressure change inside a pressure chamber when the liquid ejection head illustrated in FIG. 10 ejects the liquid and also a state inside the pressure chamber in each of the pressure states. A liquid ejection head 10X in the comparative example will be described with reference to FIGS. 10, 11A and 11B.

As illustrated in FIG. 10, the liquid ejection head 10X in the comparative example has a different structure in a nozzle plate 30X compared with the liquid ejection head 10 according to the first embodiment. Structures of other components are substantially similar.

Compared with the nozzle plate 30 according to the first embodiment, the nozzle plate 30X does not include the adhesive layer 32, resin plate 33, and air layer S1 and is formed of only the base plate 31.

As illustrated in FIGS. 11A and 11B, the liquid ejection head 10X performs ink ejecting operation in a manner substantially similar to the liquid ejection head 10 according to the first embodiment during the non-driving period R1 and driving period R2, and the pressure chamber 28*a* is also changed in a manner similar to the first embodiment.

During the period immediately after driving R3, the vibration layer 25 returns to an original shape, but the base plate 31 cannot be quickly deformed in accordance with pressure fluctuation in the pressure chamber 28*a* because the rigidity of the base plate 31 is considerably high. Consequently, a volume of the pressure chamber 28*a* is increased. Additionally, it takes quite a long time to supply the ink into the pressure chamber 28*a*. Therefore, the pressure inside the pressure chamber 28*a* becomes P3 which is considerably lower than the value P2 of the first embodiment. As a result, a pressure of the ink inside the pressure chamber 28*a* becomes lower than a saturated water vapor pressure, and bubbles are generated in the ink contained inside the pressure chamber 28*a*.

(Manufacturing Method for Liquid Ejection Head)

FIGS. 12 to 17 are views illustrating first to sixth steps of a manufacturing process for the liquid ejection head illustrated in FIG. 1. The manufacturing method for the liquid ejection head 10 according to the present embodiment will be described with reference to FIGS. 12 to 17.

Figure 12:
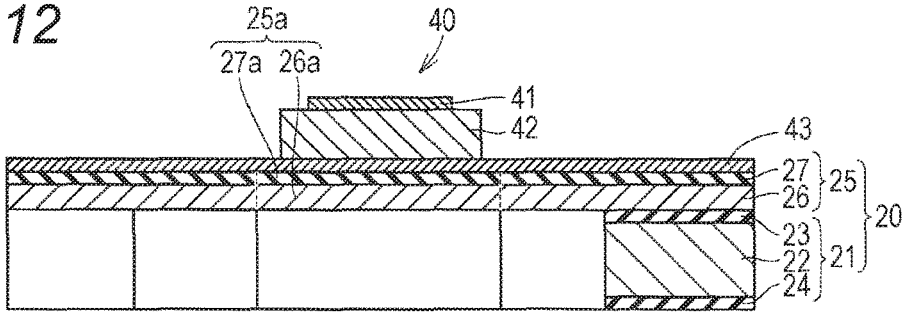
FIG. 12 is a view illustrating a first step of a manufacturing process for the liquid ejection head illustrated in FIG. 1.

As illustrated in FIG. 12, the basal plate 20 provided with the piezoelectric element 40 is prepared in the first step of the manufacturing process for the liquid ejection head. At the time of preparing the basal plate 20 provided with the piezoelectric element 40, a silicon on insulator (SOI) basal plate having an SOI structure in which two sheets of silicon are joined via an oxide film is heated at approximately 1500° C. Consequently, a basal plate having both of main surfaces formed with silicon dioxide is formed. The SOI basal plate having both of the main surfaces formed with silicon dioxide includes a portion constituting the body portion 21 and a portion constituting the vibration layer 25 through later steps.

Subsequently, a metal layer constituting the lower electrode 43 is formed on one side of the main surfaces of the heated SOI basal plate by a sputtering method or the like. Next, a piezoelectric layer is formed on the metal layer. The piezoelectric body 42 is formed by patterning the piezoelectric layer into a predetermined pattern by a photolithography method.

Next, a metal film to be the upper electrode 41 is formed on the lower electrode 43 and the piezoelectric body 42 by the sputtering method or the like. The upper electrode 41 is formed by patterning the metal film into a predetermined pattern by the photolithography method.

Subsequently, portions to become the pressure chamber 28*a*, communication passage 28*b*, common chamber 28*c*, and auxiliary chamber 28*d* are formed by patterning the other side of the SOI basal plate by using the photolithography method. The basal plate 20 provided with the piezoelectric element 40 is prepared through the above steps.

Figure 13:
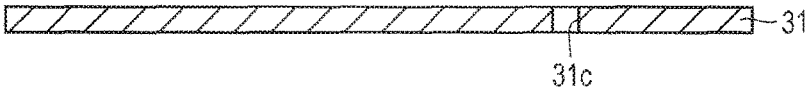
FIG. 13 is a view illustrating a second step of the manufacturing process for the liquid ejection head illustrated in FIG. 1.

As illustrated in FIG. 13, the base plate 31 constituting a part of the nozzle plate 30 is prepared in the second step of the manufacturing process for the liquid ejection head. The base plate 31 is provided with a hole portion 31*c* constituting a nozzle hole penetrating in a thickness direction.

Figure 14:
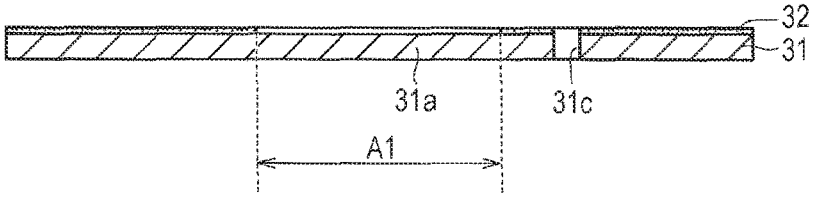
FIG. 14 is a view illustrating a third step of the manufacturing process for the liquid ejection head illustrated in FIG. 1.

As illustrated in FIG. 14, the adhesive layer 32 is provided on one of main surfaces of the base plate in the third step of the manufacturing process for the liquid ejection head. At this point, the adhesive layer 32 is provided on the one of the main surfaces of the base plate 31 excluding the portion 31*a* locationally corresponding to the pressure chamber 28*a*. A non-adhesive area A1 not including the adhesive layer 32 is formed in the portion 31*a* locationally corresponding to the pressure chamber 28*a*.

The adhesive layer 32 may be patterned by using a printing method utilizing a screen mask, or may be patterned by using a photosensitive adhesive.

Figure 15:
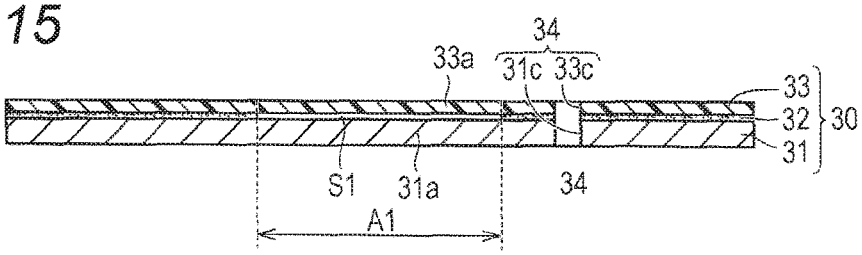
FIG. 15 is a view illustrating a fourth step of the manufacturing process for the liquid ejection head illustrated in FIG. 1.

As illustrated in FIG. 15, the resin plate 33 is joined to the base plate 31 by using the adhesive layer 32 in the fourth step of the manufacturing process for the liquid ejection head. Consequently, the nozzle plate 30 is formed.

Since the above-described non-adhesion region A1 is provided, when the resin plate 33 and the base plate 31 are joined to each other, the air layer S1 is formed between the portion 33*a* included in the resin plate 33 and locationally corresponding to the pressure chamber 28*a* and the portion 31*a* included in the base plate 31 and locationally corresponding to the pressure chamber 28*a*. Further, the nozzle hole 34 is formed by a hole portion 33*c* provided in the resin plate 33 communicating with the hole portion 31*c* of the base plate 31.

Figure 16:
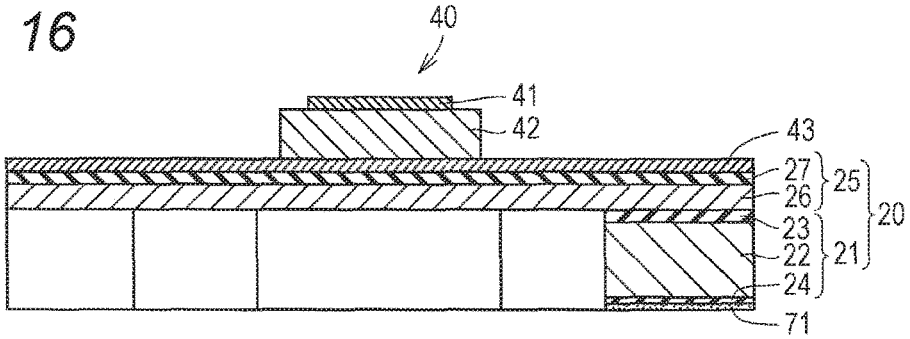
FIG. 16 is a view illustrating a fifth step of the manufacturing process for the liquid ejection head illustrated in FIG. 1.

As illustrated in FIG. 16, the adhesive 71 is applied to the main surface of the basal plate 20 located on the side opposite to the side where the piezoelectric element 40 is located in the fifth step of the manufacturing process for the liquid ejection head.

Figure 17:
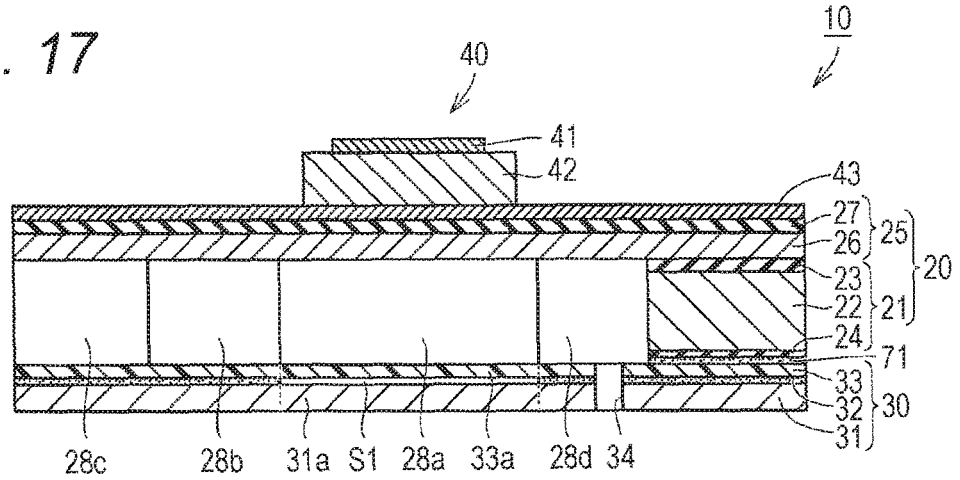
FIG. 17 is a view illustrating a sixth step of the manufacturing process for the liquid ejection head illustrated in FIG. 1.

As illustrated in FIG. 17, the nozzle plate 30 is joined, by using the adhesive 71, to the basal plate 20 provided with the piezoelectric element 40 in the sixth step of the manufacturing process for the liquid ejection head. Consequently, the lower wall for the pressure chamber 28*a*, communication passage 28*b*, common chamber 28*c*, and auxiliary chamber 28*d* are constituted by the nozzle plate 30, and the pressure chamber 28*a*, communication passage 28*b*, common chamber 28*c*, and auxiliary chamber 28*d* are formed, and also the liquid ejection head 10 according to the first embodiment is manufactured.

(Functions and Effects)

As described above, in the liquid ejection head 10 according to the present embodiment, the lower wall of the pressure chamber 28*a* is formed by arranging the resin plate 33 and the base plate 31 from the pressure chamber 28*a* side in a manner interposing the air layer S1. Therefore, the lower wall has the vibration characteristics different between the pressurized state and the depressurized state. The lower wall of the pressure chamber 28*a* is adapted to prevent driving force from being decreased in the pressurized state as described above and also reduce pressure fluctuation in the pressure chamber 28*a* in the depressurized state.

Therefore, the lower wall of the pressure chamber 28*a* reduces the negative pressure generated inside the pressure chamber 28*a* in the state that pressurization from the piezoelectric element 40 is stopped after ink ejection. As a result, it is possible to suppress a pressure of the ink contained inside the pressure chamber 28*a* from becoming lower than the saturated water vapor pressure in the depressurized state. Therefore, the liquid ejection head 10 and the ink jet printer including the same according to the present embodiment can suppress bubble generation while maintaining high output.

Second Embodiment

Figure 18:
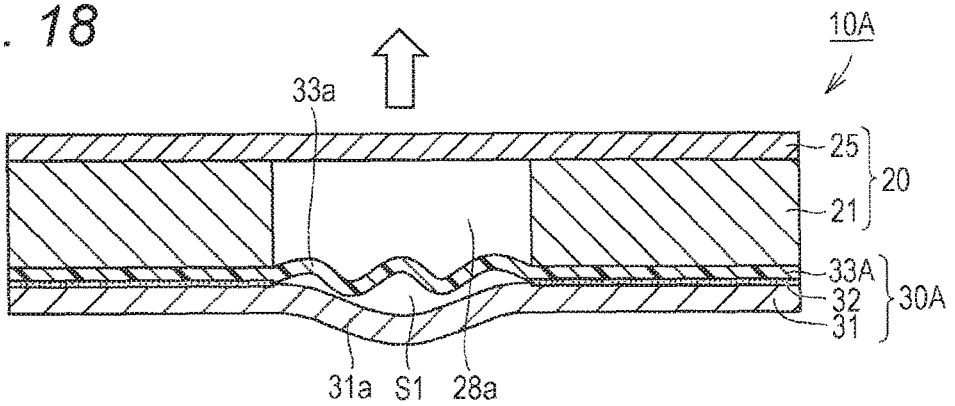
FIG. 18 is a view illustrating a depressurized state in which a pressure chamber of a liquid ejection head according to a second embodiment is depressurized.

FIG. 18 is a view illustrating a depressurized state in which a pressure chamber of a liquid ejection head according to the present embodiment is depressurized. Note that a piezoelectric element 40 and the like are omitted in FIG. 18 for the sake of convenience. The liquid ejection head according to the present embodiment will be described with reference to FIG. 18.

Compared with a liquid ejection head 10 according to a first embodiment, a liquid ejection head 10A according to the present embodiment has a different structure in a resin plate 33A included in a nozzle plate 30A. Structures of other components are substantially similar.

The resin plate 33A is provided to have viscosity different from that of a base plate 31. According to the present embodiment, a lower wall of a pressure chamber 28*a* has vibration characteristics different between a pressurized state and a depressurized state because rigidity and viscosity of the lower wall of the pressure chamber 28*a* are different between the pressurized state and the depressurized state.

In the pressurized state, the portion 33*a* included in the resin plate 33A and locationally corresponding to the pressure chamber 28*a* is deformed together with a portion 31*a* in a state that the portion 33*a* contacts the portion 31*a* included in the base plate 31 and locationally corresponding to the pressure chamber 28*a*. Consequently, the viscosity and rigidity of the lower wall of the pressure chamber 28*a* in the pressurized state is obtained by adding viscosity and rigidity of the resin plate 33 and viscosity and rigidity of the base plate 31.

On the other hand, in the depressurized state, the portion 33*a* included in the resin plate 33A and locationally corresponding to the pressure chamber 28*a* is independently deformed separately from the base plate 31 and deformed so as to come close to a vibration layer 25 in accordance with pressure change in the pressure chamber 28*a*. At this point, the portion 33*a* included in the resin plate 33A and locationally corresponding to the pressure chamber 28*a* generates high-order vibration.

Since this high-order vibration causes a large deformation angle and increases a speed thereof, viscous resistance is increased. Consequently, pressure fluctuation inside the pressure chamber 28*a* can be quickly attenuated in the depressurized state, and bubble generation can be suppressed. Meanwhile, the viscous resistance is little increased because the resin plate 33A is deformed while contacting the base plate 31 in the pressurized state. Consequently, output is prevented from significant decrease.

Thus, the liquid ejection head 10A according to the present embodiment may bring effects equal to or more than those of the liquid ejection head 10 according to the first embodiment.

Meanwhile, the description has been provided in the present embodiment for the case where the lower wall of the pressure chamber 28*a* has the different vibration characteristics between the pressurized state and the depressurized state because the rigidity and viscosity of the lower wall of the pressure chamber 28*a* are different between the pressurized state and the depressurized state. However, not limited thereto, the lower wall of the pressure chamber 28*a* may also have different vibration characteristics between the pressurized state and the depressurized state because the viscosity of the lower wall of the pressure chamber 28*a* is different between the pressurized state and the depressurized state.

Third Embodiment

Figure 19:
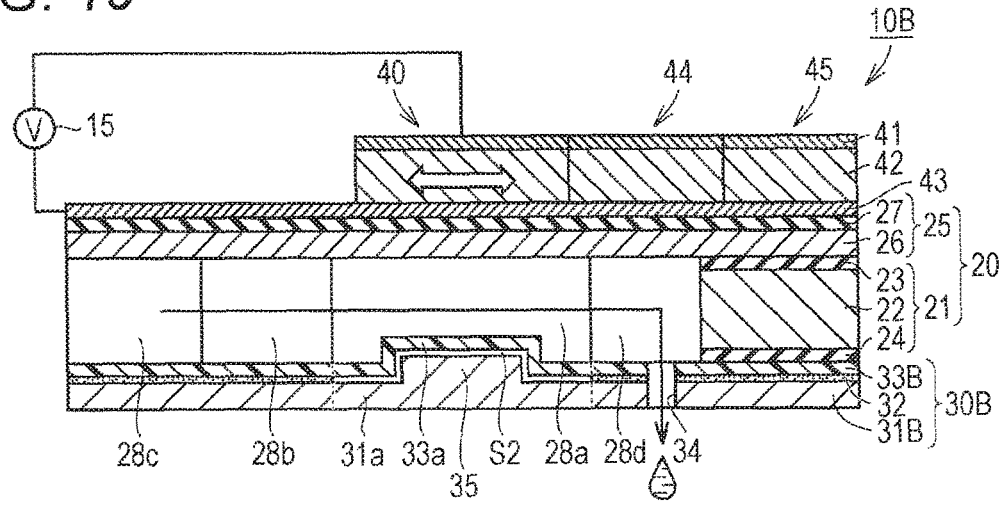
FIG. 19 is a view illustrating a cross-sectional diagram of a liquid ejection head according to a third embodiment.

FIG. 19 is a cross-sectional view of a liquid ejection head according to the present embodiment. A liquid ejection head 10B according to the present embodiment will be described with reference to FIG. 19.

As illustrated in FIG. 19, compared with a liquid ejection head 10 according to a first embodiment, a liquid ejection head 10B according to the present embodiment has a different structure in a nozzle plate 30B. Structures of other components are substantially similar.

A base plate 31B of the nozzle plate 30B has a protrusion 35 at a portion 33*a* locationally corresponding to a pressure chamber 28*a*. The protrusion 35 is provided in a manner protruding toward a vibration layer 25. The portion 33*a* included in a resin plate 33 and locationally corresponding to the pressure chamber 28*a* is provided in a manner covering the protrusion 35 via an air layer S1.

In the case of having the above-described structure, a lower wall of the pressure chamber 28*a* has vibration characteristics different between a pressurized state and a depressurized state in manner similar to the first embodiment.

In the pressurized state, the portion 33*a* included in the resin plate 33 and locationally corresponding to the pressure chamber 28*a* is deformed together with a portion 31*a* included in the base plate 31B and locationally corresponding to the pressure chamber 28*a* in a state that the portion 33*a* contacts the protrusion 35.

Figure 20:
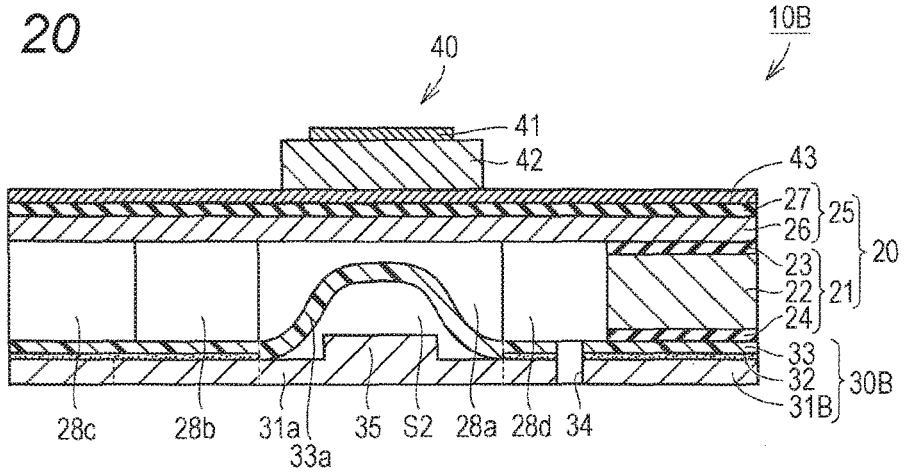
FIG. 20 is a view illustrating a depressurized state in which a pressure chamber of the liquid ejection head illustrated in FIG. 19 is depressurized.

FIG. 20 is a diagram illustrating the depressurized state in which the pressure chamber of the liquid ejection head illustrated in FIG. 19 is depressurized. The depressurized state in which the pressure chamber 28*a* of the liquid ejection head 10B is depressurized will be described with reference to FIG. 20.

In the depressurized state, the portion 33*a* included in the resin plate 33 and locationally corresponding to the pressure chamber 28*a* is independently deformed separately from the protrusion 35 of the base plate 31B and deformed so as to come close to the vibration layer 25 in accordance with pressure change in the pressure chamber 28*a* because the portion 33*a* has low rigidity.

Thus, in the liquid ejection head 10B according to the present embodiment, the vibration characteristics are also different between the pressurized state and the depressurized state, and the lower wall of the pressure chamber 28*a* is deformed so as to prevent decrease of driving force in the pressurized state and reduce pressure fluctuation in the pressure chamber 28*a* in the depressurized state. Consequently, a negative pressure generated inside the pressure chamber 28*a* is reduced while maintaining a high output, and bubble generation is suppressed.

Fourth Embodiment

Figure 21:
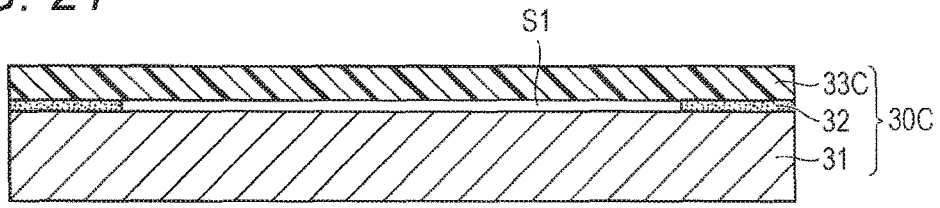
FIG. 21 is a view illustrating a nozzle plate of a liquid ejection head according to a fourth embodiment.

FIG. 21 is a view illustrating a nozzle plate of a liquid ejection head according to the present embodiment. The liquid ejection head according to the present embodiment will be described with reference to FIG. 21.

Compared with a liquid ejection head 10 according to a first embodiment, the liquid ejection head according to the present embodiment has a different structure in a nozzle plate 30C. Structures of other components are substantially similar.

The nozzle plate 30C includes a thin film layer 33C instead of a resin plate 33 according to the first embodiment. The thin film layer 33C is made of, for example, silicon, a metal film, or the like. The thin film layer 33C also functions in a manner similar to the resin plate 33 according to the first embodiment. Consequently, a lower wall of a pressure chamber 28*a* comes to have vibration characteristics different between a pressurized state and a depressurized state and is deformed so as to prevent decrease of driving force in the pressurized state and reduce pressure fluctuation in the pressure chamber 28*a* in the depressurized state. Therefore, effects substantially similar to those of the liquid ejection head 10 according to the first embodiment may also be obtained in the liquid ejection head according to the present embodiment.

Fifth Embodiment

Figure 22:
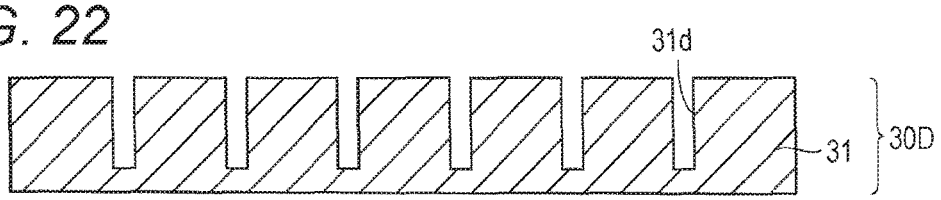
FIG. 22 is a view illustrating a nozzle plate of a liquid ejection head according to a fifth embodiment.

FIG. 22 is a view illustrating a nozzle plate of a liquid ejection head according to the present embodiment. The liquid ejection head according to the present embodiment will be described with reference to FIG. 22.

Compared with a liquid ejection head 10 according to a first embodiment, the liquid ejection head according to the present embodiment has a different structure in a nozzle plate 30D. Structures of other components are substantially similar.

The nozzle plate 30D is formed by providing a plurality of groove portions 31*d* in a base plate 31. The plurality of groove portions 31*d* is provided in a manner opened toward a pressure chamber 28*a*. The plurality of groove portions 31*d* is formed by, for example, a photolithography method.

In the case of having the above-described structure, when the nozzle plate 30D is curved so as to move away from a vibration layer 25, a portion included in the base plate 31 and defining an upper side of the groove portion 31*d* contacts the nozzle plate 30D and rigidity of the nozzle plate 30D becomes high in the pressurized state. On the other hand, when the nozzle plate 30D is curved so as to come close to the vibration layer 25, the portion included in the base plate 31 and defining the upper side of the groove portion 31*d* is separated therefrom and therefore the rigidity thereof becomes low in the depressurized state.

As described above, in the liquid ejection head according to the present embodiment, vibration characteristics are also different between the pressurized state and the depressurized state, and a lower wall of the pressure chamber 28*a* is deformed so as to prevent decrease of driving force in the pressurized state and reduce pressure fluctuation in the pressure chamber 28*a* in the depressurized state. Consequently, a negative pressure generated inside the pressure chamber 28*a* is reduced while maintaining a high output, and bubble generation is suppressed.

Sixth Embodiment

Figure 23:
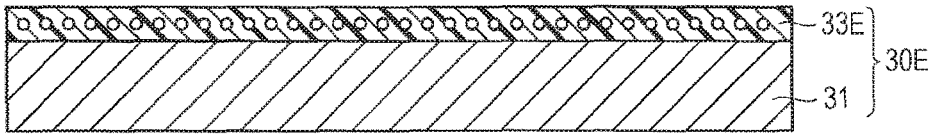
FIG. 23 is a view illustrating a nozzle plate of a liquid ejection head according to a sixth embodiment.

FIG. 23 is a view illustrating a nozzle plate of a liquid ejection head according to the present embodiment. The liquid ejection head according to the present embodiment will be described with reference to FIG. 23.

Compared with a liquid ejection head 10 according to a first embodiment, the liquid ejection head according to the present embodiment has a different structure in a nozzle plate 30E. Structures of other components are substantially similar.

The nozzle plate 30E includes a base plate 31 and a porous silicon layer 33E. The porous silicon layer 33E can be formed by etching a surface of the base plate 31 made of silicon with solution of hydroelectric acid or the like. The porous silicon layer 33E is arranged in a manner facing a pressure chamber 28*a*.

In the case of having the above-described structure, when the nozzle plate 30E is curved so as to move away from a vibration layer 25, a plurality of holes included in a silicon layer 33E is crushed in the pressurized state. Consequently, a portion included in the base plate 31 and located in a periphery of the plurality of holes contacts the nozzle plate, and rigidity of the nozzle plate 30E becomes high. On the other hand, when the nozzle plate 30E is curved so as to come close to the vibration layer 25, the plurality of holes is separated from each other and the rigidity of the nozzle plate 30E becomes low in a depressurized state.

As described above, in the liquid ejection head according to the present embodiment, vibration characteristics are also different between the pressurized state and the depressurized state, and a lower wall of the pressure chamber 28*a* is deformed so as to prevent decrease of driving force in the pressurized state and reduce pressure fluctuation in the pressure chamber 28*a* in the depressurized state. Consequently, a negative pressure generated inside the pressure chamber 28*a* is reduced while maintaining a high output, and bubble generation is suppressed.

Seventh Embodiment

Figure 24:
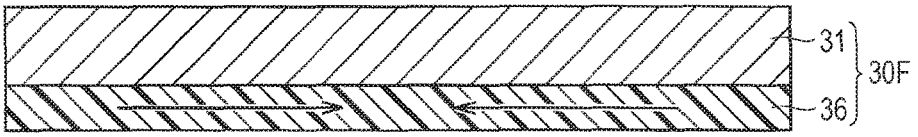
FIG. 24 is a view illustrating a nozzle plate of a liquid ejection head according to a seventh embodiment.

FIG. 24 is a view illustrating a nozzle plate of a liquid ejection head according to the present embodiment. The liquid ejection head according to the present embodiment will be described with reference to FIG. 24.

Compared with a liquid ejection head 10 according to a first embodiment, the liquid ejection head according to the present embodiment has a different structure in a nozzle plate 30F. Structures of other components are substantially similar.

The nozzle plate 30F includes a base plate 31 and a stress control film 36. The stress control film 36 is provided on a main surface of the base plate 31 located on a side opposite to a side where a pressure chamber 28*a* is located. The stress control film 36 is formed so as to have tensile stress, for example. The stress control film 36 is made of, for example, a SiN layer. The SiN film is formed by vapor deposition, a CVD method, or the like.

In the case of having the above-described structure, the nozzle plate 30F is hardly deformed by action of tensile stress when the nozzle plate 30F is curved so as to move away from a vibration layer 25 in the pressurized state. On the other hand, the nozzle plate 30F is easily deformed by action of the tensile stress when the nozzle plate 30F is curved so as to come close to the vibration layer 25.

As described above, in the liquid ejection head according to the present embodiment, vibration characteristics are also different between the pressurized state and the depressurized state, and a lower wall of the pressure chamber 28*a* is deformed so as to prevent decrease of driving force in the pressurized state and reduce pressure fluctuation in the pressure chamber 28*a* in the depressurized state. Consequently, a negative pressure generated inside the pressure chamber 28*a* is reduced while maintaining a high output, and bubble generation is suppressed.

Eighth Embodiment

Figure 25:
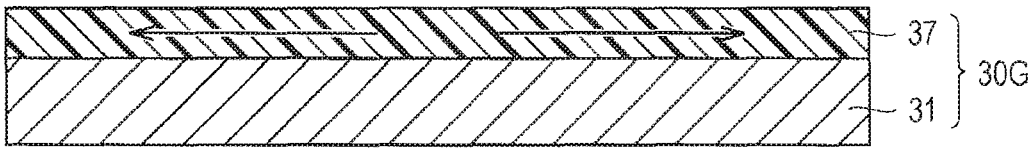
FIG. 25 is a view illustrating a nozzle plate of a liquid ejection head according to an eighth embodiment.

FIG. 25 is a view illustrating a nozzle plate of a liquid ejection head according to the present embodiment. The liquid ejection head according to the present embodiment will be described with reference to FIG. 25.

Compared with a liquid ejection head 10 according to a first embodiment, the liquid ejection head according to the present embodiment has a different structure in a nozzle plate 30G. Structures of other components are substantially similar.

The nozzle plate 30G includes a base plate 31 and a stress control film 37. The stress control film 37 is provided on a main surface of the base plate 31 located on a side where a pressure chamber 28*a* is located. The stress control film 37 is formed so as to have compressive stress, for example. The stress control film 37 is made, for example, a $SiO_2$ layer. The $SiO_2$ layer is formed by thermal oxidation, vapor deposition, a CVD method, or the like.

In the case of having the above-described structure, the nozzle plate 30G is hardly deformed by action of compressive stress when the nozzle plate 30G is curved so as to move away from a vibration layer 25 in the pressurized state. On the other hand, the nozzle plate 30G is easily deformed by action of the compressive stress when the nozzle plate 30G is curved so as to come close to the vibration layer 25.

As described above, in the liquid ejection head according to the present embodiment, vibration characteristics are also different between the pressurized state and the depressurized state, and a lower wall of the pressure chamber 28*a* is deformed so as to prevent decrease of driving force in the pressurized state and reduce pressure fluctuation in the pressure chamber 28*a* in the depressurized state. Consequently, a negative pressure generated inside the pressure chamber 28*a* is reduced while maintaining a high output, and bubble generation is suppressed.

Meanwhile, the description has been provided in the above-described first to eighth embodiments by exemplifying the case where the lower wall of the pressure chamber 28*a* has the vibration characteristics different between the pressurized state and the depressurized state, but not limited thereto, an upper wall or a peripheral wall of the pressure chamber 28*a* may have vibration characteristics different between the pressurized state and the depressurized state.

Additionally, the liquid ejection head according to the above-described second to seventh embodiments may be applicable to the ink jet printer according to the first embodiment.

The liquid ejection head according to the above-described present invention includes: the ejection port to eject liquid; the pressure chamber communicating with the ejection port; and the piezoelectric element adapted to pressurize the pressure chamber and eject, from the ejection port, the liquid stored in the pressure chamber. In the liquid ejection head, at least a part of the wall portion defining the pressure chamber includes a portion where vibration characteristics are different between the pressurized state in which the pressure chamber is pressurized by the piezoelectric element and the depressurized state in which the pressure chamber is depressurized by ejecting the liquid from the ejection port and stopping pressurization to the pressure chamber. The portion having the different vibration characteristics is adapted to reduce pressure fluctuation in the pressure chamber in the depressurized state.

In the liquid ejection head according to the above-described present invention, preferably, the portion of the wall portion defining the pressure chamber is located on a wall portion different from the side where the piezoelectric element is arranged.

In the liquid ejection head according to the above-described present invention, the portion having different vibration characteristics has rigidity in the depressurized state lower than rigidity in the pressurized state.

In the liquid ejection head according to the above-described present invention, the portion having different vibration characteristics has viscosity in the depressurized state lower than viscosity in the pressurized state.

In the liquid ejection head according to the above-described present invention, preferably, the portion having different vibration characteristics includes a first layer and a second layer which has higher rigidity than that of the first layer and is formed separately from the first layer so as to form a gap in a space with the first layer, and preferably, the first layer and second layer are sequentially arranged from the pressure chamber side. In this case, preferably, the first layer is deformed together with the second layer in the state of contacting the second layer in the pressurized state, and preferably, the first layer is deformed independently from the second layer in the depressurized state.

In the liquid ejection head according to the above-described present invention, preferably, the above-mentioned gap is formed of an air layer filled with air.

In the liquid ejection head according to the above-described present invention, the second layer may have a protrusion protruding toward the pressure chamber. In this case, preferably, the first layer covers the protrusion so as to form a gap in a space with the protrusion.

In the liquid ejection head according to the above-described present invention, preferably, the first layer is made of resin, silicon, or a metal film.

In the liquid ejection head according to the above-described present invention, the portion having the different vibration characteristics may also be formed by providing a plurality of groove portions opened toward the pressure chamber side on at least a part of the wall portion defining the pressure chamber.

In the liquid ejection head according to the above-described present invention, preferably, the portion having the different vibration characteristics includes a first layer and a second layer sequentially arranged from the pressure chamber side. In this case, the first layer may be made of a porous member.

In the liquid ejection head according to the above-described present invention, preferably, the portion having the different vibration characteristics includes a first layer and a second layer sequentially arranged from the pressure chamber side. In this case, the first layer may be made of a stress control film adapted to apply tensile stress to the portion having the different vibration characteristics.

In the liquid ejection head according to the above-described present invention, preferably, the portion having the different vibration characteristics includes a first layer and a second layer sequentially arranged from the pressure chamber side. In this case, the first layer may be formed of a stress control film adapted to apply compressive stress to the portion having the different vibration characteristics.

The ink jet printer according to the present invention includes the above-described liquid ejection head and performs printing by ejecting liquid toward a recording medium from the liquid ejection head.

While the embodiments of the present invention have been described above, the embodiments disclosed herein are examples in all respects and not intended to be limitative. The scope of the present invention is defined by the scope of the claims and includes meanings equivalent to the scope of claims and all modifications within the scope.

REFERENCE SIGNS LIST

1 Ink jet printer
2 Ink jet head portion
3 Feed roll
4 Wind-up roll
5*a*, 5*b* Back roll
6 Intermediate tank
6T, 7T Pipe line
7 Liquid feed pump
8 Storage tank
9 Fixing device
10, 10A, 10B, 10X Liquid ejection head
15 Driving unit
20 Basal plate
21 Body portion
22 Body basal plate
23, 24 Insulation film
25, 25*a* Vibration layer
26 Driven plate
27 Insulation film
28*a* Pressure chamber

28*b* Communication passage
28*c* Common chamber
28*d* Auxiliary chamber
29 Ink supply hole
30, 30A, 30B, 30C, 30D, 30E, 30F, 30G, 30X Nozzle plate
31, 31B Base plate
31*c* Hole portion
31*d* Groove portion
32 Adhesive layer
33, 33A Resin plate
33*c* Hole portion
33C Thin film layer
33E Silicon layer
34 Nozzle hole
35 Protrusion
36, 37 Stress control film
40 Piezoelectric element
41 Upper electrode
42 Piezoelectric body
43 Lower electrode
44 Connecting portion
45 Wiring portion
50 Ink supply unit
51 Cylindrical portion
52 Ink introduction passage
71 Adhesive

The invention claimed is:

1. A liquid ejection head comprising:

an ejection port configured to eject liquid;

a pressure chamber communicating with the ejection port; and a piezoelectric element configured to pressurize the pressure chamber and eject, from the ejection port, the liquid stored in the pressure chamber, wherein a lower wall of the pressure chamber includes a portion where vibration characteristics are different between a pressurized state in which the pressure chamber is pressurized by the piezoelectric element and a depressurized state in which the pressure chamber is depressurized by ejecting the liquid from the ejection port and stopping pressurization to the pressure chamber, the portion having different vibration characteristics is configured to reduce pressure fluctuation in the pressure chamber in the depressurized state, the portion having different vibration characteristics includes a first layer and a second layer having rigidity higher than rigidity of the first layer, the second layer being formed separately from the first layer so as to form a gap in a space with the first layer, the first layer and the second layer are sequentially arranged from the pressure chamber side, the first layer is deformed together with the second layer in a state of contacting the second layer in the pressurized state, and the first layer is deformed independently from the second layer in the depressurized state.

2. The liquid ejection head according to claim 1, wherein the part of the wall of the pressure chamber is located on a wall portion different from a side where the piezoelectric element is arranged.

3. The liquid ejection head according to claim 2, wherein the portion having different vibration characteristics has rigidity in the depressurized state lower than rigidity in the pressurized state.

4. The liquid ejection head according to claim 2, wherein the portion having different vibration characteristic is formed by providing a plurality of groove portions opened toward the pressure chamber side on at least a part of the wall portion defining the pressure chamber.

5. The liquid ejection head according to claim 2, wherein the first layer is made of a porous member.

6. The liquid ejection head according to claim 2, wherein the first layer is formed of a stress control film configured to apply tensile stress to the portion having different vibration characteristics.

7. The liquid ejection head according to claim 2, wherein the first layer is formed of a stress control film configured to apply compressive stress to the portion having different vibration characteristics.

8. The liquid ejection head according to claim 1, wherein the portion having different vibration characteristics has rigidity in the depressurized state lower than rigidity in the pressurized state.

9. The liquid ejection head according to claim 1, wherein the gap is formed of an air layer filled with air.

10. The liquid ejection head according to claim 1, wherein the second layer has a protrusion protruding toward the pressure chamber, and the first layer covers the protrusion so as to form a gap in a space with the protrusion.

11. The liquid ejection head according to claim 1, wherein the first layer is made of resin, silicon, or a metal film.

12. The liquid ejection head according to claim 1, wherein the portion having different vibration characteristic is formed by providing a plurality of groove portions opened toward the pressure chamber side on at least a part of the wall portion defining the pressure chamber.

13. The liquid ejection head according to claim 1, wherein the first layer is made of a porous member.

14. The liquid ejection head according to claim 1, wherein the first layer is formed of a stress control film configured to apply tensile stress to the portion having different vibration characteristics.

15. The liquid ejection head according to claim 1, wherein the first layer is formed of a stress control film configured to apply compressive stress to the portion having different vibration characteristics.

16. An ink jet printer including the liquid ejection head according to claim 1 and configured to perform printing by ejecting the liquid toward a recording medium from the liquid ejection head.

* * * * *